United States Patent [19]

Vullierme

[11] Patent Number: 4,708,352

[45] Date of Patent: Nov. 24, 1987

[54] PLASTIC ADJUSTABLE ROLLER SKATE

[75] Inventor: Paul Vullierme, Aix les Bains, France

[73] Assignee: Etablissements Vullierme S.A., Rumilly, France

[21] Appl. No.: 885,855

[22] Filed: Jul. 15, 1986

[30] Foreign Application Priority Data

Jul. 18, 1985 [FR] France ..... 85 11206

[51] Int. Cl.[4] ..... A63C 17/02

[52] U.S. Cl. ..... 280/11.26; 280/11.28; 280/11.3

[58] Field of Search ..... 280/11.26, 11.28, 11.19, 280/11.3

[56] References Cited

U.S. PATENT DOCUMENTS

| | | | |
|---|---|---|---|
| 326,540 | 9/1885 | Baker | 280/11.28 |
| 2,037,964 | 4/1936 | Chochkoff | 280/11.3 |
| 3,007,706 | 11/1961 | Pullen | 280/11.26 |
| 3,649,038 | 3/1972 | Huckenbeck | 280/11.28 |
| 4,072,317 | 2/1978 | Pommerening | 280/11.3 |
| 4,184,693 | 1/1980 | Whitmarsh | 280/11.28 |
| 4,398,735 | 8/1983 | Evans et al. | 280/11.28 |

*Primary Examiner*—David M. Mitchell

*Attorney, Agent, or Firm*—Karl F. Ross; Herbert Dubno; Andrew Wilford

[57] ABSTRACT

An adjustable roller skate has a front toe platform and a rear heel platform longitudinally behind the toe platform. One of the platforms is formed with a longitudinal extension telescoping in the other platform. Respective front and rear axles carried on the platforms in turn carry respective front and rear wheels. Respective toe and heel retainers on the platforms shaped to engage around the toe and heel of a foot on the skate are secured to this foot by at least one strap engageable over the foot in the retainers. A longitudinal row of teeth is formed on the extension and an elastic tongue is longitudinally nondisplaceable on the other platform and formed with teeth. This tongue is displaceable between a locking position with its teeth engaged in the teeth of the extension and thereby securing the two platforms against relative longitudinal displacement and a freeing position with its teeth out of engagement with the teeth of the extension and the two platforms relatively longitudinally displaceable. A pivotal latch dog is provided on the other platform for displacing the tongue between its positions and for releasably holding it in the locking position.

8 Claims, 4 Drawing Figures

PLASTIC ADJUSTABLE ROLLER SKATE

FIELD OF THE INVENTION

The present invention relates to a roller skate. More particularly this invention concerns an adjustable or slipon skate.

BACKGROUND OF THE INVENTION

A standard adjustable roller skate comprises a front toe platform and a rear heel platform carrying respective axles in turn carrying respective front and rear wheels. Toe and heel retainers on the platforms are shaped to engage around the toe and heel of a foot on the skate and at least one strap is secured to the retainers and engageable over the foot in the retainers to secure same in place therein.

In order that the two platforms can be relatively longitudinally displaced to accommodate feet of different lengths, one of the platforms is formed with a longitudinal extension telescoping in the other platform and some sort of latch arrangement is provided to lock the two platforms relative to each other once the desired length is set. The typical such latch arrangement is a screw and nut that extend through the extension and that are tightened to lock the two parts relative to each other.

Such a skate is typically of relatively complex construction, mainly made of stamped sheet metal and comprising a multiplicity of complex and different parts. Such skates are heavy and expensive to manufacture, but safety requirements have been felt to preclude other styles of construction.

OBJECTS OF THE INVENTION

It is therefore an object of the present invention to provide an improved adjustable roller skate.

Another object is the provision of such an adjustable roller skate which overcomes the above-given disadvantages, that is which is inexpensive and simple to manufacture and which is quite light.

A further object is to provide a skate which can be adjusted easily, without the use of any tools.

SUMMARY OF THE INVENTION

An adjustable roller skate according to the invention has a front toe platform and a rear heel platform longitudinally behind the toe platform. One of the platforms is formed with a longitudinal extension telescoping in the other platform. Respective front and rear axles carried on the platforms in turn carry respective front and rear wheels. Respective toe and heel retainers on the platforms shaped to engage around the toe and heel of a foot on the skate are secured to this foot by at least one strap engageable over the foot in the retainers. A longitudinal row of teeth is formed on the extension and an elastic tongue is longitudinally nondisplaceable on the other platform and formed with teeth. This tongue is displaceable between a locking position with its teeth engaged in the teeth of the extension and thereby securing the two platforms against relative longitudinal displacement and a freeing position with its teeth out of engagement with the teeth of the extension and the two platforms relatively longitudinally displaceable. A latch is provided on the other platform for displacing the tongue between its positions and for releasably holding it in the locking position.

This construction is extremely simple and inexpensive to manufacture. The entire construction can be of a durable synthetic resin, such as Delrin TM, linear polyethylene, or filled polypropylene. Hence the structure is quite light and durable, so that it is ideal for use by small children.

According to a feature of this invention the tongue is pivotal about a transverse axis on the other platform. In addition each platform is provided with a respective angled outer arm having a lower end carrying the respective axle. These arms are limitedly flexible for limited vertical movement of the respective shafts. Each platform is provided with a respective angled inner arm lying within and above the respective outer arm and having a lower end normally spaced vertically above the lower end of the respective outer arm. For best cushioning each inner arm is stiffer with regard to upward deflectability of its lower end than the respective outer arm. The lower end of each inner arm is formed with a downwardly open recess complementary to the lower end of the respective outer arm and the lower end of each outer arm is snugly fittable in the respective recess on upward deflection. Finally each platform is provided spaced above the lower end of each inner arm with an abutment engageable with the lower end of the respective inner arm on upward deflection of same.

According to another feature of this invention each outer arm is provided with a longitudinally projecting tab and each inner arm is provided with a downwardly open notch normally spacedly receiving the respective tab. Thus the lower end of each outer arm can flex transversely somewhat relative to the respective inner-arm lower end, making it easier to corner with the skates of this invention.

The toe retainer comprises a part normally lying on the instep of the foot engaged in the retainers and the strap passes over the instep part. This instep part is displaceable longitudinally on the toe retainer relative to the toe platform for maximum adjustability.

DESCRIPTION OF THE DRAWING

The above and other features and advantages will become more readily apparent from the following, it being understood that any feature described with reference to one embodiment of the invention can be used where possible with any other embodiment. In the accompanying drawing.

SPECIFIC DESCRIPTION

Figure 1:
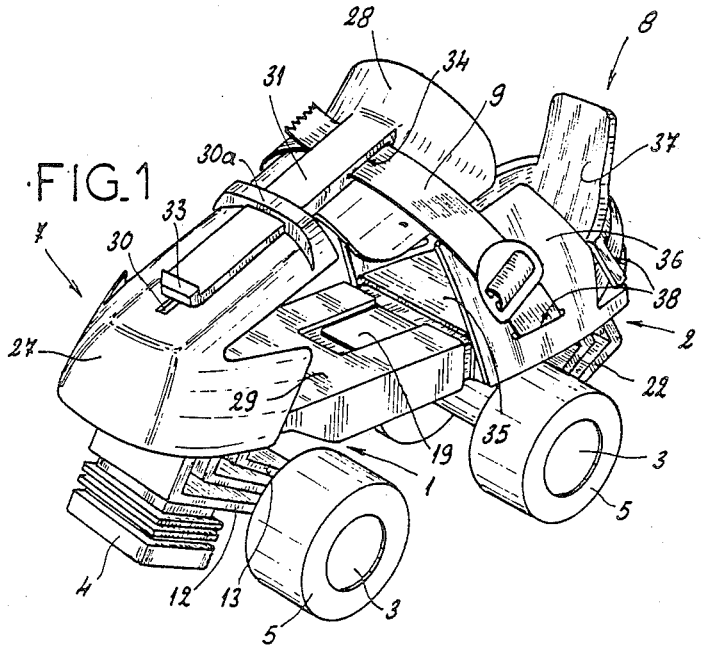
FIG. 1 is a perspective view of a roller skate according to this invention.
Figure 2:
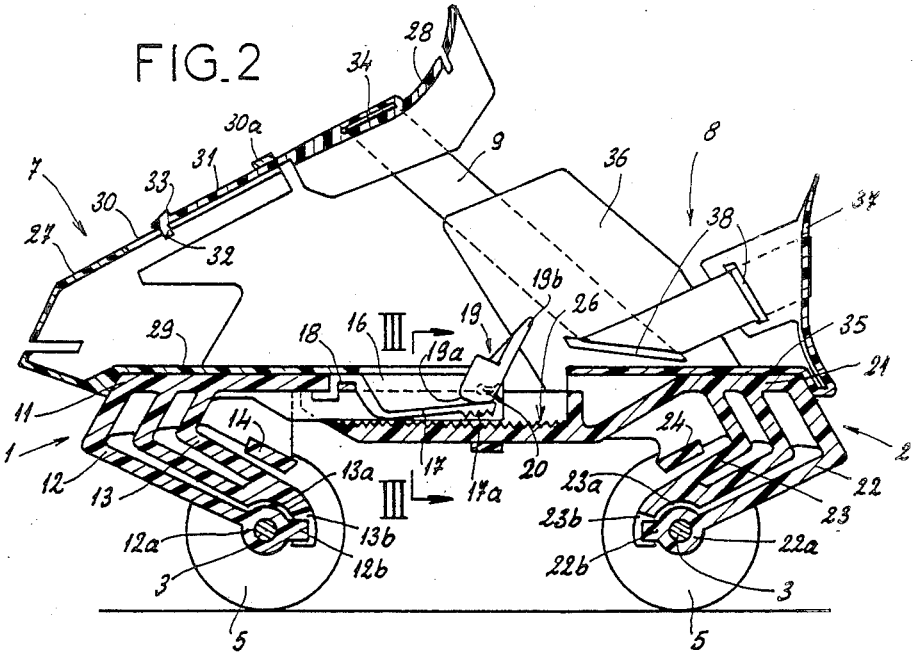
FIG. 2 is a longitudinal and vertical section through the skate of FIG. 1.
Figure 3:
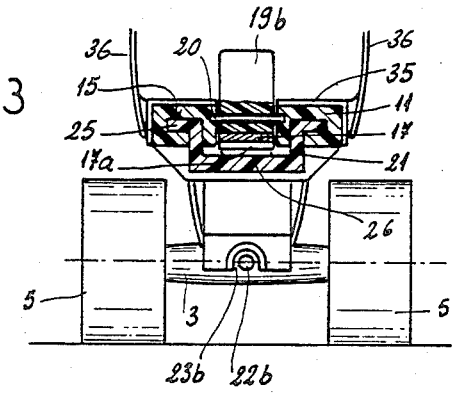
FIG. 3 is a vertical cross section taken along line III—III of FIG. 2.

As seen in FIGS. 1 through 3, the skate according to this invention basically comprises a front toe platform 1 and a rear heel platform 2 both formed entirely of a durable synthetic resin and each carrying a respective horizontal axle 3 in turn carrying a pair of identical synthetic-resin wheels 5. These platforms 1 and 2 are formed with respective toe and heel retainer shells 7 and 8, the latter serving as the anchor for a main holding belt or strap 9.

The front platform 1 is formed as a longitudinally extending beam 11 provided at its front end with outer and inner downwardly and backwardly bent arms 12 and 13, the former carrying the standard toe stop 4. The arm 12 is formed at its lower end with a cylindrical hub 12*a* for the respective roller axle 3 and has a rearwardly projecting tab 12*b*. The arm 13 is double, that is has two parts each of the same thickness and resilience as the single front arm 12 and is formed at its lower end with a downwardly open semicylindrical seat 13*a* spacedly surrounding the hub 12*a* and with a downwardly open but laterally closed notch 13*b* into which the tab 12*b* extends. In addition the front part 1 is formed above the lower end of the rear arm 13 with a stationary abutment 14. Similarly the rear platform 2 is formed as a longitudinally extending and generally C-section channel beam 21 provided at its rear end with outer and inner downwardly and forwardly bent arms 22 and 23. The arm 22 is formed at its lower end with a cylindrical hub 22*a* for the respective roller axle 3 and has a forwardly projecting tab 22*b*. The arm 23 is double like the arm 13 and is formed at its lower end with a semicylindrical seat 23*a* spacedly surrounding the hub 22*a* and with a downwardly open but laterally closed notch 23*b* into which the tab 22*b* extends. In addition the rear part 2 is formed above the lower end of the rear arm 23 with a stationary abutment 24.

Thus the wheels 5 can bounce up and down fairly freely until the respective hubs 12*a* and 22*a* engage the respective recesses 13*a* and 23*a*, whereupon upward flexing is limited with some force, and when the arms 13 and 23 are similarly bent enough to engage the abutments 14 and 24 upward movement is stopped. Similarly the axles 3 can twist within the range permitted by the play between the lugs 12*b* and 22*b* and the respective notches 13*b* and 23*b*. As a result even in a wholly plastic construction a very comfortable ride is produced, with increasing resistance to deflection with increasing deflection.

The front beam 11 is formed with a central cutout 16 and with a pair of transversely inwardly open slots 15 receiving respective longitudinal wings or ribs 25 projecting horizontally and transversely oppositely from the beam 21. An elastic latching tongue 17 is secured at 18 to the beam 11 and a cam dog 19 is pivoted at 20 in the notch 16 above this tongue 17.

Figure 4:
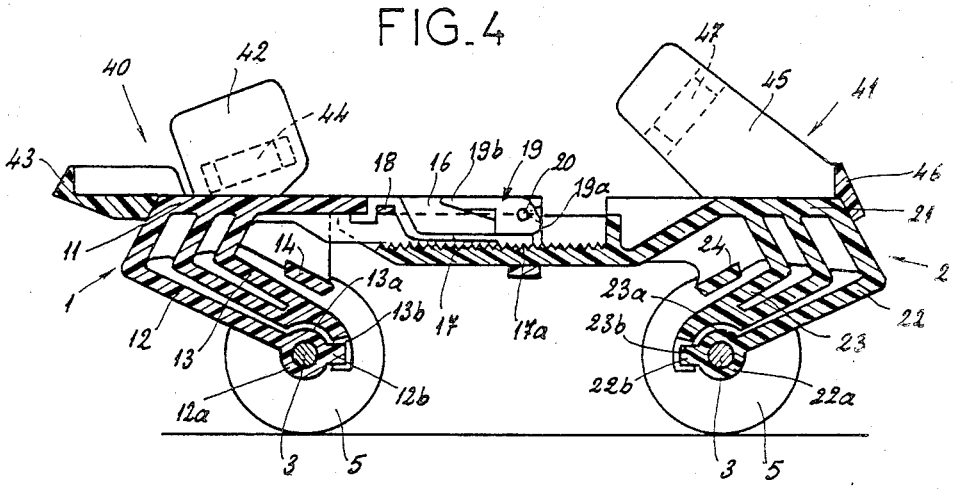
FIG. 4 is a view like FIG. 2 of another skate according to the invention.

The U-section beam or bar 21 of the rear part 2 is formed with a longitudinal row of upwardly projecting teeth 26 complementary to teeth 17*a* on the lower face of the rear end of the elastic tongue 17. In addition the latch dog 19 has a body 19*a* that can press down against the rear end of the tongue 17 to force the teeth 17*a* into mesh with the teeth 26 as shown in FIG. 4 and an actuating lever 19*b* that extends horizontally flush with the beam 11 when in this position but that extends upward when the teeth 17*a* and 26 are not engaged, as illustrated in FIG. 2.

Thus it is possible to adjust the length of the skate relatively easily by flipping up the lever part 19*b* and then sliding the part 1 relative to the part 2 to the desired position. Then the cam 19 is pivoted down to lock this setting. In this down position the body 19*a* bears on the tongue 17 in back of its pivot 20 so that the dog 19 holds.

The toe retainer 7 has a toe-retaining shell 27 formed like the toe region of a shoe and having a floor or sole part 29 secured permanently to the top of the front beam 11. A vamp part 28 formed with a slot 34 for the strap 9 has a forwardly and downwardly projecting tongue 31 provided at its front end with a lug 32 that projects downward through a slot 30 in the part 27 and with an abutment 33 that projects upward and that can abut a stop 30*a* formed on the part 27. Thus the part 28 can slide forward and backward on the part 27 to allow the part 28 to fit snugly with the the instep of the wearer.

The heel retainer 8 has a base or sole part 35 fixed to the top of the rear platform 2, a pair of side flaps 36, and a rear flap 37. These flaps 36 and 37 are formed with slots 38 through which the strap 9 passes so that when this strap 9 is tightened the foot engaged in the skate is in effect wrapped by this strap 9 and is thereby solidly but comfortably retained.

In the arrangement of FIG. 4 structure identical to that of FIGS. 1 through 3 is assigned the same reference numerals. Here, however, the retainers 7 and 8 are replaced by retainers 40 and 41. The toe retainer 40 has a pair of side tabs 42 and a front toe stop 43. The side tabs 42 are provided with anchors 44 for a toe strap. The heal retainer 41 comprises a pair of side tabs 45 and a rear heel stop 46 and these tabs 45 are provided with anchors 47 for a separate strap that passes over the user's instep.

I claim:

1. An adjustable roller skate comprising:

a front toe platform;

a rear heel platform longitudinally behind the toe platform, one of the platforms being formed with a longitudinal extension telescoping in the other platform;

respective front and rear axles carried on the platforms;

a respective angled outer arm on each platform having a lower end carrying the respective axle, the arms being limitedly flexible for limited vertical movement of the respective axles;

a respective angled inner arm on each platform lying within and above the respective outer arm and having a lower end normally spaced vertically above the lower end of the respective outer arm;

respective abutments on the platforms spaced above the lower ends of the respective inner arms and each engagable with the lower end of the respective inner arm on upward deflection of same;

respective front and rear wheels carried on the axles;

respective toe and heel retainers on the platforms shaped to engage around the toe and heel of a foot on the skate;

at least one strap engaged with the retainers and engageable over the foot in the retainers to secure same in place therein;

a longitudinal row of teeth formed on the extension;

an elastic tongue longitudinally nondisplaceable on the other platform and formed with teeth, the tongue being displaceable between a locking position with its teeth engaged in the teeth of the extension and thereby securing the two platforms against relative longitudinal displacement and a freeing position with its teeth out of engagement with the teeth of the extension and the two platforms relatively longitudinally displaceable; and latch means on the other platform for displacing the tongue between its positions and for releasably holding it in the locking position.

2. The adjustable roller skate defined in claim 1 wherein the tongue is pivotal about a transverse axis on the other platform.

3. The adjustable roller skate defined in claim 1 wherein each inner arm is constructed and arranged to be stiffer with regard to upward deflectability of its lower end than the respective outer arm.

4. The adjustable roller skate defined in claim 1 wherein the lower end of each inner arm is formed with a downwardly open recess complementary to the lower end of the respective outer arm and the lower end of each outer arm is snugly fittable in the respective recess on upward deflection.

5. The adjustable roller skate defined in claim 1 wherein each outer arm is provided with a longitudinally projecting tab and each inner arm is provided with a downwardly open notch normally spacedly receiving the respective tab, whereby the lower end of each outer arm can flex transversely somewhat relative to the respective inner-arm lower end.

6. The adjustable roller skate defined in claim 1 wherein the toe retainer comprises a part normally lying on the instep of the foot engaged in the retainers and the strap passes over the instep part.

7. The adjustable roller skate defined in claim 6, further comprising means for displacement of the instep part longitudinally on the toe retainer relative to the toe platform.

8. An adjustable roller skate comprising:

a front toe platform formed unitarily of one piece of a synthetic resin;

a rear heel platform longitudinally behind the toe platform and also formed unitarily of one piece of a synthetic resin, one of the platforms being formed with a longitudinal extension telescoping in the other platform;

respective front and rear axles carried on the platforms;

a respective angled outer arm formed unitarily of the resin with each platform having a lower end carrying the respective axle, the arms being limitedly flexible for limited vertical and transverse movement of the respective axles;

a respective angled inner arm formed unitarily of the resin with each platform lying within and above the respective outer arm and having a lower end normally spaced vertically above the lower end of the respective outer arm;

respective abutments on the platforms spaced above the lower ends of the respective inner arms and each engageable with the lower end of the respective inner arm on upward deflection of same;

respective front and rear wheels carried on the axles;

respective toe to heel retainers on the platforms shaped to engage around the toe and heel of a foot on the skate;

at least one strap engaged with the retainers and engageable over the foot in the retainers to secure same in place therein;

a longitudinal row of teeth formed on the extension;

an elastic tongue longitudinally nondisplaceable on the other platform and formed with teeth, the tongue being displaceable between a locking position with its teeth engaged in the teeth of the extension and thereby securing the two platforms against relative longitudinal displacement and freeing position with its teeth out of engagement with the teeth of the extension and the two platforms relatively longitudinally displaceable; and latch means on the other platform for displacing the tongue between its positions and for releasably holding it in the locking position.

* * * * *